US009840933B2

(12) United States Patent
Chochua et al.

(10) Patent No.: US 9,840,933 B2
(45) Date of Patent: Dec. 12, 2017

(54) APPARATUS FOR EXTENDING THE FLOW RANGE OF TURBINES

(71) Applicant: Schlumberger Technology Corporation, Sugar Land, TX (US)

(72) Inventors: Gocha Chochua, Sugar Land, TX (US); Kent D. Harms, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 438 days.

(21) Appl. No.: 14/577,757

(22) Filed: Dec. 19, 2014

(65) Prior Publication Data

US 2016/0177773 A1 Jun. 23, 2016

(51) Int. Cl.

| | |
|---|---|
| ***F01D 1/04*** | (2006.01) |
| ***F01D 17/10*** | (2006.01) |
| ***F01D 9/04*** | (2006.01) |
| ***E21B 41/00*** | (2006.01) |
| ***E21B 4/02*** | (2006.01) |
| ***F03B 13/02*** | (2006.01) |

(52) U.S. Cl.

CPC ..... *F01D 17/10* (2013.01); *E21B 4/02* (2013.01); *E21B 41/0085* (2013.01); *F01D 1/04* (2013.01); *F01D 9/04* (2013.01); *F03B 13/02* (2013.01)

(58) Field of Classification Search

CPC . F01D 1/04; F01D 17/10; F01D 11/16; F01D 11/18; F03B 13/02; E21B 4/02; E21B 4/0085

See application file for complete search history.

(56) References Cited

U.S. PATENT DOCUMENTS

| | | | | | |
|---|---|---|---|---|---|
| 3,520,635 | A | * | 7/1970 | Ivanko | F01D 11/18 415/127 |
| 3,765,791 | A | * | 10/1973 | Trappmann | F01D 9/042 415/131 |
| 5,018,942 | A | * | 5/1991 | Ciokajlo | F01D 11/22 415/127 |
| 5,056,988 | A | * | 10/1991 | Corsmeier | F01D 11/22 415/126 |
| 5,203,673 | A | * | 4/1993 | Evans | F01D 11/22 415/10 |
| 5,228,828 | A | * | 7/1993 | Damlis | F01D 11/22 415/173.2 |
| 5,295,787 | A | * | 3/1994 | Leonard | F01D 11/18 415/134 |
| 6,030,174 | A | | 2/2000 | Maier et al. | |

(Continued)

*Primary Examiner* — Woody Lee, Jr.

(57) ABSTRACT

An apparatus for extending the operational flow rate range of a turbine is described herein. Two or more removable sleeves may be used to change the cross-sectional area of a turbine. Each removable sleeve may define or eliminate the stator gap between a stator blade tip and an inner wall of the removable sleeve and a rotor gap between a rotor blade tip and an inner wall of the removable sleeve. A movable sleeve may be disposed in the turbine and may move between a first position and a second position in response to changes in the pressure differential across the turbine. The movable sleeve may define or eliminate a stator gap between a stator blade tip and the inner conical surface of the sleeve or a hub of the turbine and a rotor gap between a rotor blade tip and the inner conical surface of the sleeve.

20 Claims, 10 Drawing Sheets

(56) References Cited

U.S. PATENT DOCUMENTS

| | | | | |
|---|---|---|---|---|
| 6,382,905 | B1 * | 5/2002 | Czachor | F01D 11/122 415/128 |
| 6,672,831 | B2 * | 1/2004 | Brandl | F01D 11/22 415/173.2 |
| 6,763,899 | B1 | 7/2004 | Ossia et al. | |
| 7,988,409 | B2 | 8/2011 | Moriarty | |
| 8,727,709 | B2 * | 5/2014 | Bolgar | F01D 11/22 415/127 |
| 9,441,499 | B2 * | 9/2016 | Casavant | F01D 11/18 |
| 2005/0152778 | A1 * | 7/2005 | Lewis | F01D 5/20 415/174.4 |
| 2007/0196205 | A1 * | 8/2007 | Moriarty | E21B 4/02 415/191 |
| 2016/0377092 | A1 * | 12/2016 | Edwards | F04D 29/161 415/208.1 |

* cited by examiner

APPARATUS FOR EXTENDING THE FLOW RANGE OF TURBINES

BACKGROUND

This disclosure relates to turbines and, more particularly, to extending the flow range of turbines.

Power generation turbines and alternators are used for downhole drilling operations to supply electrical power to electronic components used for measuring, logging, or sampling while drilling. As drilling mud passes through a stationary blade row in the turbine, it generates an angular momentum, or flow swirl, in expense of the pressure differential. The downstream rotating blade row, or rotor, converts that angular momentum, as well as its own reaction, into the shaft power, and supplies it to an alternator to generate electricity. During operation, the power generation turbine has to operate within a range of flow rates and as dictated by job operating conditions. This limited range of turbine operation typically does not cover the entire rig operating flow rate range that can be expected for a particular tool size. A turbine operating below an optimal flow rate range may produce insufficient power for the electronic components. A turbine operating above an optimal flow rate range may experience relatively high thermal stresses and/or accelerated wear of attached mechanical components, thus reducing reliability and service life. Moreover, replacing a damaged or worn turbine may be time-consuming and expensive and, in some instances, may be impossible once the turbine is installed downhole. Moreover, an operator may mistakenly select a turbine that is not optimized for the particular flow rate.

Additionally, the mud flow in the turbine typically contains suspended solid particles, such as sand. These particles, passing at a high speed across the turbine blade rows and especially at conditions outside of the turbine's flow rate range, can cause erosion to the blades or downstream turbine components. The replacement of these eroding parts may increase overall maintenance material and supply (M&S) tool costs and increase service frequency.

SUMMARY

A summary of certain embodiments disclosed herein is set forth below. It should be understood that these embodiments and associated aspects are presented merely to provide the reader with a brief summary of these certain embodiments and that the associated aspects are not intended to limit the scope of this disclosure. Indeed, this disclosure may encompass a variety of embodiments and aspects that may not be set forth below.

Embodiments of this disclosure relate to an apparatus for extending the flow range of a turbine. In some embodiments, a turbine is provided that includes a movable sleeve disposed with the turbine and axially movable between a first position and a second position in response to changes in a pressure differential between a first location in the turbine and a second location in the turbine. The movable sleeve includes an inner wall and at least a portion of the inner wall having an inner conical surface. The turbine also includes a stator blade coupled to the inner wall of the movable sleeve and a rotor blade coupled to a hub of the turbine. The movable sleeve in the first position engages the tip of the stator blade with the hub of the turbine and defines a first gap having a first width between a tip of the rotor blade and the inner conical surface of the movable sleeve. The movable sleeve in the second position defines a second gap having a second width between a tip of the stator blade and the hub of the turbine, such that the second width is greater than zero.

In some embodiments, a turbine is provided that includes a movable sleeve disposed within the turbine and axially movable between a first position and a second position in response to changes in a pressure differential between a first location in the turbine and a second location in the turbine. The movable sleeve includes an inner wall, at least a portion of the inner wall having an inner conical surface. The turbine includes a stator blade coupled to a hub of the turbine. A first width is defined between a tip of the stator blade and the inner conical surface of the movable sleeve. The turbine also includes a rotor blade coupled to the hub of the turbine. A second width is defined between a tip of the rotor blade and the inner conical surface of the movable sleeve. The movable sleeve in the first position engages the tip of the stator blade such that the first width is about zero. The movable sleeve in the second position increases a gap between the tip of the stator blade and the surface of the hub such that the first width is greater than zero.

In some embodiments, an apparatus is provided that includes a first removable sleeve disposable in a turbine and having a first inner wall. The first removable sleeve defines a first width between a tip of the stator blade and the wall and defines a second width between a tip of the rotor blade and the inner conical surface of the movable sleeve. The apparatus also includes a second removable sleeve disposable within the turbine and having a second inner wall. The second removable sleeve engages the tip of the stator blade such that the first width is about zero and is configured to decrease the second width.

BRIEF DESCRIPTION OF THE DRAWINGS

Various embodiments and associated aspects of this disclosure may be better understood upon reading the following detailed description and upon reference to the drawings in which.

DETAILED DESCRIPTION

Figure 1:
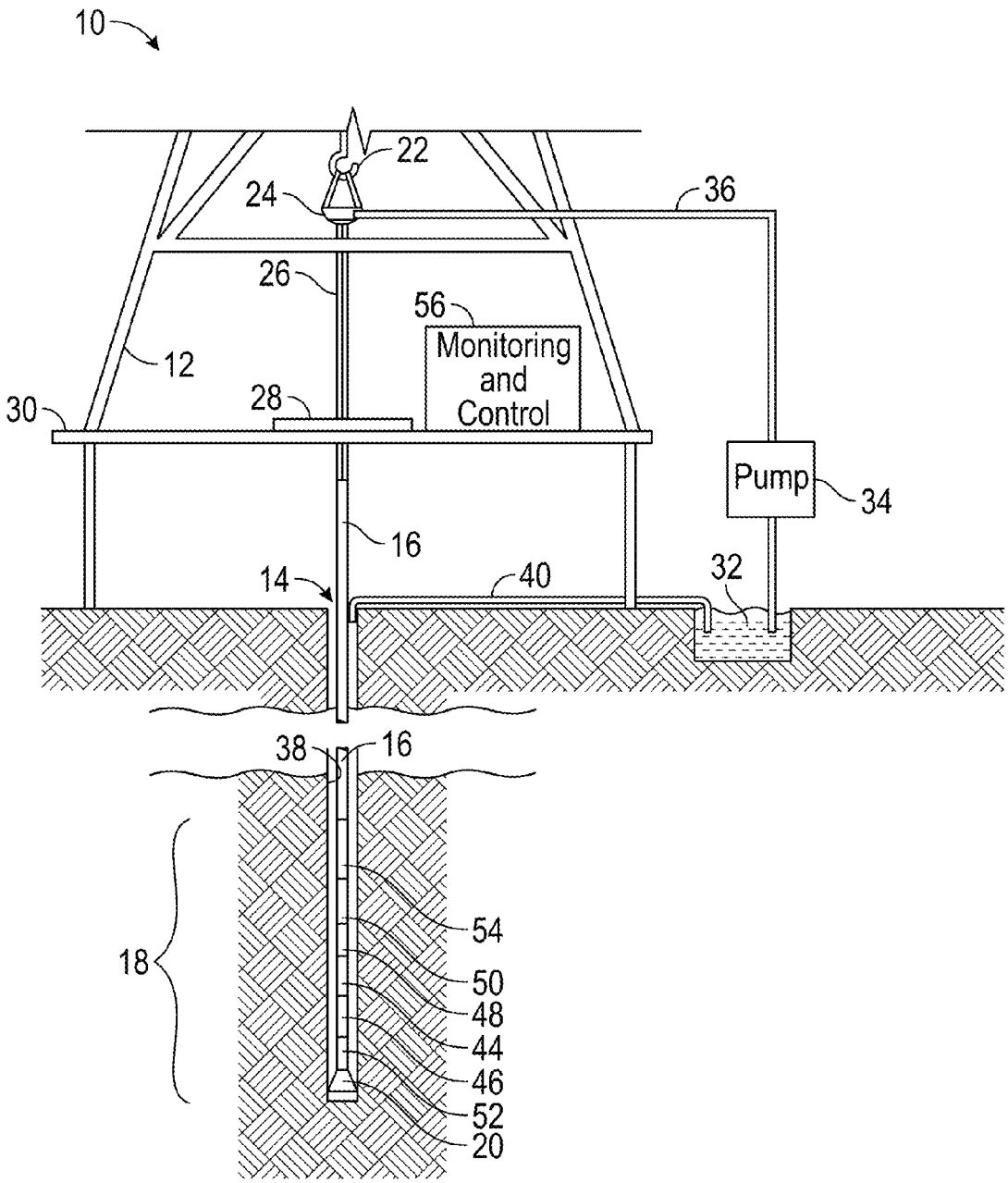
FIG. 1 is schematic diagram of a drilling system in accordance with an embodiment of the disclosure.

Described herein are various implementations related to sleeves for extending the operational flow rate range of a turbine. In some embodiments, two or more removable sleeves may be used to change the cross-sectional area of a turbine. A first removable sleeve may define a stator gap between a stator blade tip and an inner wall of the sleeve and a rotor gap between a rotor blade tip and an inner wall of the sleeve. A removable sleeve may eliminate the stator gap between a stator blade tip and an inner wall of the sleeve and decrease the rotor gap between a rotor blade tip and an inner wall of the sleeve. The first removable sleeve may increase the cross-sectional area of the turbine and allow operation of the turbine at higher flow rates.

In some embodiments, a movable sleeve is disposed in the turbine. The movable sleeve moves between a first position and a second position in response to changes in the pressure differential across the turbine. The movable sleeve has an inner wall with an inner conical surface that defines a stator gap between a stator blade tip and the inner conical surface of the sleeve and a rotor gap between a rotor blade tip and the inner conical surface of the sleeve. The turbine includes a stationary sleeve and a spring disposed between the movable sleeve and the stationary sleeve. The spring biases the movable sleeve to the first position such that the inner conical surface of the sleeve engages the tip of the stator blade, and the stator gap is eliminated. When the pressure differential across the turbine (e.g., between a first location in turbine and a second location in the turbine) increases above a pressure differential threshold, the spring compresses and the movable sleeve moves to the second position. In the second position, the stator gap is created between the stator blade tip and the inner conical surface of the sleeve, and the width of the rotor gap is increased.

In some embodiments, a movable sleeve is disposed in the turbine. The movable sleeve moves between a first position and a second position in response to changes in the pressure differential across the turbine. A stator blade is coupled to the movable sleeve such that a stator gap is defined between the tip of the stator blade and the hub of the turbine. The movable sleeve has an inner wall with an inner conical surface that defines a rotor gap between a rotor blade tip and the inner conical surface of the sleeve. The turbine includes a stationary sleeve and a spring disposed between the movable sleeve and the stationary sleeve. The spring biases the movable sleeve to the first position such that the tip of the stator blade engages the hub of the turbine, and the stator gap is eliminated. When the pressure differential across the turbine increases, the spring compresses and the movable sleeve moves to the second position. In the second position, the stator gap is created between the stator blade tip and the hub of the turbine, and the width of the rotor gap is increased.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

More specifically, a drilling system 10 is depicted in FIG. 1 in accordance with one embodiment. While certain elements of the drilling system 10 are depicted in this figure and generally discussed below, it will be appreciated that the drilling system 10 may include other components in addition to, or in place of, those presently illustrated and discussed. It should be appreciated that the drilling system 10 depicted in FIG. 1 is merely one example of a system that may use the turbine sleeves described herein and other systems, such as completion systems, may also use the turbine sleeves described below. As depicted, the drilling system 10 can include a drilling rig 12 positioned over a well 14. Although depicted as an onshore drilling system 10, it is noted that the drilling system could instead be an offshore drilling system. The drilling rig 12 can support a drill string 16 that includes a bottomhole assembly 18 having a drill bit 20. The drilling rig 12 can rotate the drill string 16 (and its drill bit 20) to drill the well 14.

The drill string 16 can be suspended within the well 14 from a hook 22 of the drilling rig 12 via a swivel 24 and a kelly 26. Although not depicted in FIG. 1, the skilled artisan will appreciate that the hook 22 can be connected to a hoisting system used to raise and lower the drill string 16 within the well 14. As one example, such a hoisting system could include a crown block and a drawworks that cooperate to raise and lower a traveling block (to which the hook 22 is connected) via a hoisting line. The kelly 26 can be coupled to the drill string 16, and the swivel 24 can allow the kelly 26 and the drill string 16 to rotate with respect to the hook 22. In the presently illustrated embodiment, a rotary table 28 on a drill floor 30 of the drilling rig 12 can be constructed to grip and turn the kelly 26 to drive rotation of the drill string 16 to drill the well 14. In other embodiments, however, a top drive system could instead be used to drive rotation of the drill string 16.

During operation, drill cuttings or other debris may collect near the bottom of the well 14. Drilling fluid 32, also referred to as drilling mud, can be circulated through the well 14 to remove this debris. The drilling fluid 32 may also clean and cool the drill bit 20 and provide positive pressure within the well 14 to inhibit formation fluids from entering the wellbore. In FIG. 1, the drilling fluid 32 can be circulated through the well 14 by a pump 34. The drilling fluid 32 can be pumped from a mud pit (or some other reservoir, such as a mud tank) into the drill string 16 through a supply conduit 36, the swivel 24, and the kelly 26. The drilling fluid 32 can exit near the bottom of the drill string 16 (e.g., at the drill bit 20) and can return to the surface through the annulus 38 between the wellbore and the drill string 16. A return conduit 40 can transmit the returning drilling fluid 32 away from the well 14. In some embodiments, the returning drilling fluid 32 can be cleansed (e.g., via one or more shale shakers, desanders, or desilters) and reused in the well 14. The drilling fluid 32 may include an oil-based mud (OBM) that may include synthetic muds, diesel-based muds, or other suitable muds.

In addition to the drill bit 20, the bottomhole assembly 18 can also include various instruments. For example, as depicted in FIG. 1, the bottomhole assembly 18 can include a logging-while-drilling (LWD) module 44 and a measurement-while-drilling (MWD) module 46. Both modules can include sensors, housed in drill collars, that can collect data and enable the creation of measurement logs in real-time during a drilling operation. The modules could also include memory devices for storing the measured data. The LWD module 44 can include sensors that measure various characteristics of the rock and formation fluid properties within the well 14. The bottomhole assembly 18 can also include one or more additional modules 48, which could be LWD modules, MWD modules, sampling-while-drilling modules, or some other modules. It is noted that the bottomhole assembly 18 is modular, and that the positions and presence of particular modules of the assembly could be changed as desired. Further, as discussed in detail below, one or more of the modules 44, 46, and 48 can be or can include a fluid sampling tool configured to obtain a sample of a fluid from a subterranean formation and perform downhole fluid analysis to measure various properties of the sampled fluid. These properties may include an estimated density and/or optical density of the OBM filtrate, the sampled fluid, and other fluids. These and other estimated properties may be determined within or communicated to the LWD module 44, such as for subsequent utilization as input to various control functions and/or data logs.

The bottomhole assembly 18 can also include other modules. As depicted in FIG. 1 by way of example, such other modules can include a turbine generator 50, a steering module 52, and a communication module 54. In one embodiment, the turbine generator 50 may be driven by the flow of drilling mud through the drill string 16, out of the drill bit 20, and through the annulus 38 to the return conduit 40. As seen in FIG. 1, the drill string 12 is generally aligned along a longitudinal z-axis. Components of the drill string 12 may be located within the drill string at various radial distances from the z-axis, as illustrated by a radial r-axis. Certain components, such as the turbine generator 50, may include parts that rotate circumferentially along a circumferential c-axis. The turbine generator 50 may convert the hydraulic power of the drilling fluid 32 moving through the drill string 16 into mechanical rotational power in a rotating shaft. The rotating shaft may rotate along the z-axis in the same circumferential direction of the c-axis. In other embodiments, however, the turbine generator 50 may cause the rotating axis to rotate in the opposite direction. The rotating shaft, which may also include or be referred to as a rotor, provides the mechanical power that will be used to generate electrical power. The rotation of the rotating shaft may cause an alternator to generate electrical power for the electrical components.

The steering module 52 may include a rotary-steerable system that facilitates directional drilling of the well 14. The communication module 54 can enable communication of data (e.g., data collected by the LWD module 44 and the MWD module 46) between the bottomhole assembly 18 and the surface. In one embodiment, the communication module 54 can communicate via mud pulse telemetry, in which the communication module 54 uses the drilling fluid 32 in the drill string 16 as a propagation medium for a pressure wave encoding the data to be transmitted.

The drilling system 10 can also include a monitoring and control system 56. The monitoring and control system 56 can include one or more computer systems that enable monitoring and control of various components of the drilling system 10. The monitoring and control system 56 can also receive data from the bottomhole assembly 18 (e.g., data from the LWD module 44, the MWD module 46, and the additional module 48) for processing and for communication to an operator, to name just two examples. While depicted on the drill floor 30 in FIG. 1, it is noted that the monitoring and control system 56 could be positioned elsewhere, and that the monitoring and control system 56 could be a distributed system with elements provided at different places near or remote from the well 14.

As noted above, the turbine generator 50 may include a turbine for generating power. A turbine generator 50 may include a turbine that may operate over a range of flow rates of the drilling fluid 32. Existing turbines may attempt to generate the required power at a minimum flow range and below a maximum free spin velocity by varying the blade angles of the turbine blades either discretely via different turbines or automatically via variable blade angle geometry. The flow rate ranges may also be extended by alternating the cross-sectional area of the turbine. An increase in the cross-sectional area, without a blade height increase, will lead to a clearance gap increase and a reduction in volumetric efficiency. In accordance with the embodiments described herein, various apparatuses are disclosed for changing the cross-sectional area of a turbine without changing the geometry of the blades to accommodate a wider range of flow rates. In some embodiments, the cross-sectional area of a turbine may be changed using a selection of removable sleeves. In some embodiments, the cross-sectional area of a turbine may be changed using axial translation of a spring-loaded movable sleeve that moves in response to the axial force generated by the fluid flow pressure of the drilling fluid 32.

Figure 2A:
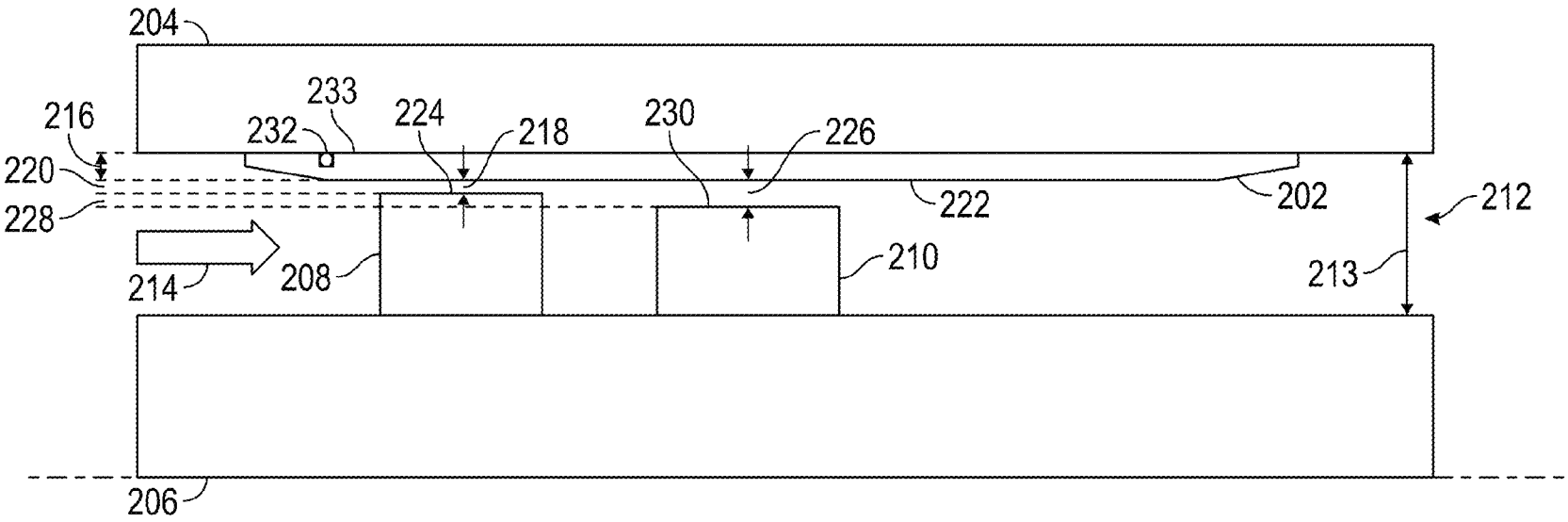
FIGS. 2A and 2B are schematic diagrams of a cross-section of a turbine portion having removable sleeves in accordance with an embodiment of the disclosure.
Figure 2B:
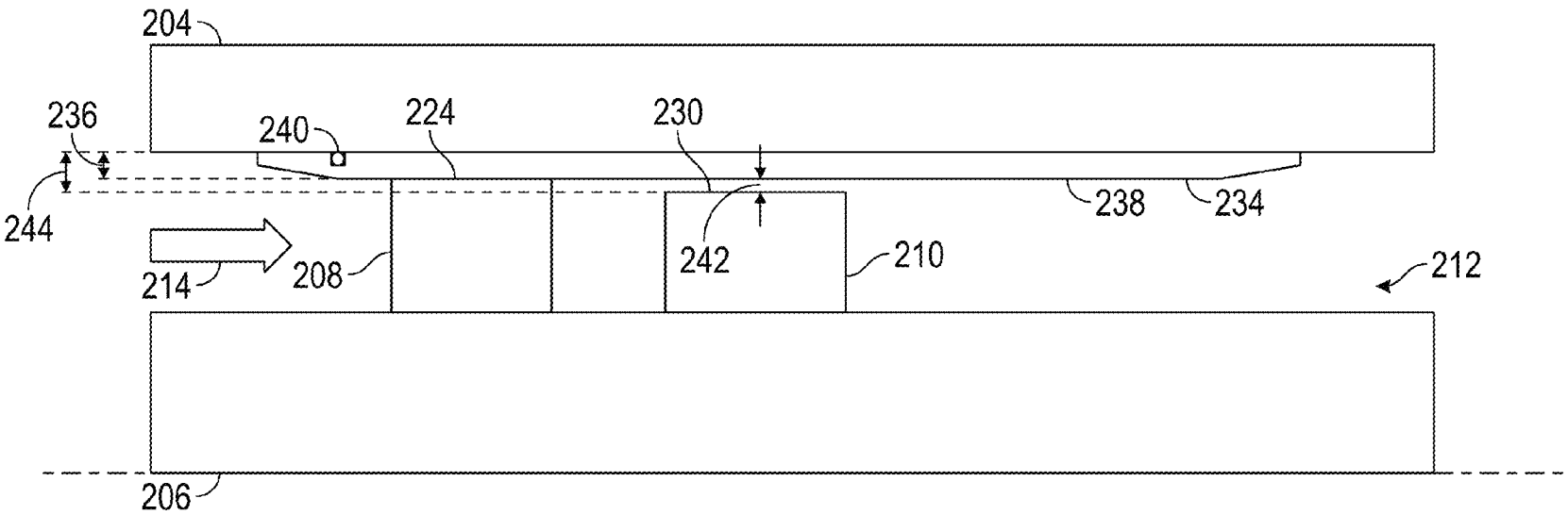

FIGS. 2A and 2B depict cross-sectional side views of a turbine portion 200 having two different removable sleeves that change the cross-sectional area of the turbine portion 200 in accordance with embodiments of the disclosure. FIG. 2A depicts an embodiment of a turbine portion 200 having a removable sleeve 202 in accordance with an embodiment of the disclosure. As shown in FIG. 2A, the turbine portion 200 includes a housing 204, a hub 206, a stator blade 208, and a rotor blade 210. The housing 204 and the hub 206 may define an annulus 212 having a diameter 213. The stator blade 208 and the rotor blade 210 may be coupled to the hub 206 and disposed within the annulus 212, with the rotor blade 210 coupled to a rotating portion of the hub 206. In some embodiments, any number of stator blades 208 and rotor blades 210 may be included in the turbine portion 200. Fluid flow through the turbine portion 200 is represented by arrow 214.

Various removable sleeves may be inserted into the annulus 212 to define a gap between a wall of the housing 204 and the tip of a stator blade and a rotor blade. For example, as shown in FIG. 2A, the removable sleeve 202 may be of a thickness 216 that defines a stator gap 218 of width 220 between a wall 222 of the removable sleeve 202 and a tip 224 of the stator blade 208. Similarly, the removable sleeve 202 may define a rotor gap 226 of width 228 between the wall 222 of the removable sleeve 202 and a tip 230 of the rotor blade 210. The inner diameter of the removable sleeve 202 may be selected to ensure that the gaps 218 and 226 change the power output and free spin velocity to satisfy the power requirements for a specific flow rate range. For example, as compared to the removable sleeve depicted in FIG. 2B and described below, the removable sleeve 202 in FIG. 2A may satisfy free spin velocity requirements at higher flow rates by increasing the stator gap 218 and the rotor gap 226. Thus, the removable sleeve 202 may be inserted when the turbine portion 200 is used in a relatively higher flow rate range. In some embodiments, the removable sleeve 202 may include a seal 232. The seal 232 may be selected to eliminate leakage in the passage 233 between the removable sleeve 202 and the housing 204.

To change the cross-sectional area of the annulus 212, the removable sleeve 202 may be removed from the turbine portion 200. In some embodiments, the turbine portion 200 may be operated without a removable sleeve. In some embodiments, other removable sleeves having different inner diameters may be inserted into the annulus 212. For example, FIG. 2B depicts an embodiment of the turbine portion 200 having a second removable sleeve 234 in accordance with an embodiment of the disclosure. As shown in FIG. 2B, the second removable sleeve 234 may have a thickness 236 and a wall 238. The second removable sleeve 234 may also include a seal 240. In the embodiment shown in FIG. 2B, the thickness 236 of the second removable sleeve 234 is greater than the thickness 216 of the removable sleeve 202. The second removable sleeve 234 may define a rotor gap 242 having a width 244 between the wall 238 and the rotor tip 230. However, in contrast to the removable sleeve embodiment depicted in FIG. 2A, the width 244 of the rotor gap 242 is smaller than the width 228 of the rotor gap 226 of FIG. 2A. The second removable sleeve 234 may be selected for minimum power requirements at lower flow rates. Accordingly, the inner diameter of the second removable sleeve 234 may be selected to fully close a gap between the stator tip 224 and the wall 238 of the second removable sleeve 234 and to ensure the rotor gap 242 is at its minimum allowable value to avoid rub between the rotor blade 210 and the housing 204. In some embodiments, a removable sleeve may modify (e.g., increase or decrease) the gap between a rotor blade and the housing without changing the gap between the stator blade and the housing. In other embodiments, a removable sleeve may modify (e.g., increase or decrease) the gap between a stator blade and the housing without changing the gap between the rotor blade and the housing.

In the embodiments depicted in FIGS. 2A and 2B, one stator and one rotor may be designed since the allowable flow rate range is controlled via the selection of different inner diameters for various removable sleeves. Consequently, the same stator and rotor parts may be used across a variety of flow rate conditions, and field locations may stock different removable sleeves, thus reducing M&S costs. Additionally, the inner diameters of the removable sleeves may be measured to ensure that the appropriate removable sleeve is used in a particular flow rate range if, for example, part numbers or other identifications are eroded from the sleeves. In some embodiments, a stator gap and a rotor gap may create a flow bypass, such that the fluid flow near the housing may have a reduced swirl. Moreover, due to the centrifugal force, most of the erosive particles in the drilling fluid will be concentrated near the outer circumference of the annulus. The flow bypass created by the stator gap and the rotor gap may provide a low swirl flow that shields downstream components from erosion and may increase the service life or refurbish life of such components. Moreover, it should be appreciated that FIGS. 2A and 2B depict an example of a single stage turbine; however, the removable sleeves may be used in other embodiments having multistage turbines.

Figure 3A:
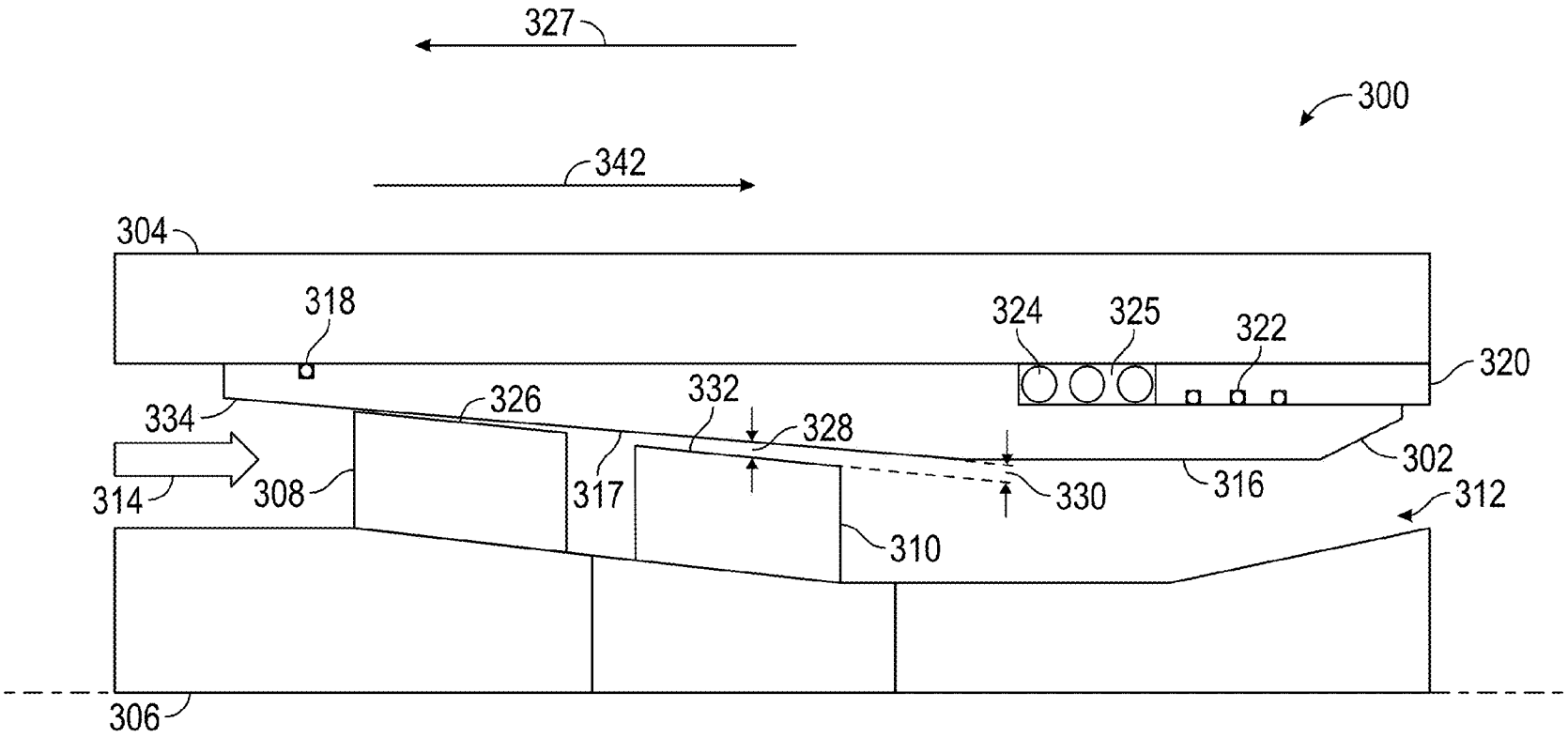
FIGS. 3A and 3B are schematic diagrams of a cross-section of a turbine portion having a movable sleeve in accordance with an embodiment of the disclosure.
Figure 3B:
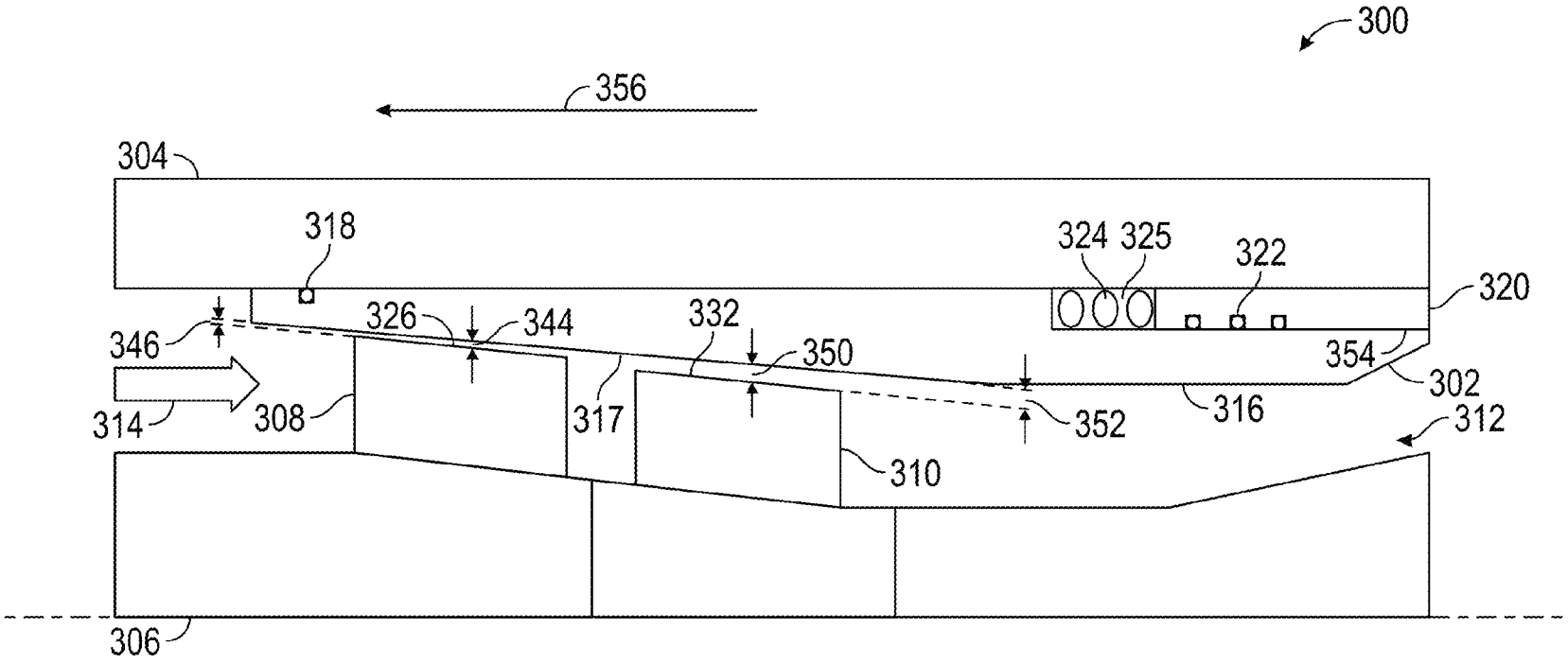

In some embodiments, a movable sleeve that automatically moves in response to changes in fluid flow pressure may be used to change the cross-sectional area of a turbine and change the flow rate range of the turbine. FIGS. 3A and 3B depict cross-sectional side views of an embodiment of a turbine portion 300 having a movable sleeve 302 in accordance with an embodiment of the disclosure. As shown in FIG. 3A, the turbine portion 300 includes a housing 304, a hub 306, a stator blade 308, and a rotor blade 310. The housing 304 and the hub 306 may define an annulus 312. The stator blade 308 and the rotor blade 310 may be coupled to the hub 306 and disposed within the annulus 312, with the rotor blade 310 coupled to a rotating portion of the hub 306. In some embodiments, any number of stator blades 308 and rotor blades 310 may be included in the turbine portion 300. Fluid flow through the turbine portion 300 is represented by arrow 314.

The movable sleeve 302 may include an inner wall 316 having a conical surface 317 and a seal 318. The illustrated turbine portion 300 also includes a stationary sleeve 320 having debris excluders 322 that may prevent the spring from collecting solids that could restrict movement of the spring 324. A spring 324 may be disposed between the movable sleeve 302 and the stationary sleeve 320, such as in a spring cavity 325. As described further below, the movable sleeve 302 may translate axially within the annulus 312 to define (e.g., increase, decrease, or eliminate) a gap between the stator and a wall of the movable sleeve 302 and a gap between the rotor and a wall of the movable sleeve 302.

As shown in FIG. 3A, the movable sleeve 302 may be in a first position such that the spring 324 is in a preloaded state. At relatively low flow rates and as shown in FIG. 3A, the spring 324 may bias the movable sleeve 302 in the direction indicated by arrow 327 to push the movable sleeve 302 against the stator blade 208. Thus, in the first position illustrated in FIG. 3A, the gap between a tip 326 of the stator blade 308 and the wall 316 of the movable sleeve 302 is eliminated, such that the tip 326 of the stator blade 308 has zero radial clearance with the conical surface 317. In the first position, a rotor gap 328 having a width 330 may be defined between a tip 332 of the rotor blade 310 and the wall 316 of the movable sleeve 302, such that a minimal radial clearance exists between the movable sleeve 302 and the rotor blade tip 332 to avoid rubbing during operation of the turbine including shock conditions. In some embodiments, in the first position a relatively small gap may be maintained between the stator blade tip 326 and the wall 316. In such embodiments, a small gap in the first position may aid in minimize vibration or chattering at "lift-off" of the turbine.

In some embodiments, the inner conical surface 334 of the movable sleeve 302 may have a similar or equal conical angle to the meridional profiles of the rotor tip 332, the stator tip 326, or both. Similarly, various portions of the hub 306 may have angled surfaces that may, in some embodiments, equal the conical angle of the inner conical surface 334, the stator tip 326, the rotor tip 332, or a combination thereof. In other embodiments, the movable sleeve 302 may have an inner surface having a different shape other than a conical surface.

As the fluid flow increases in the direction indicated by arrow 308, the pressure differential across the turbine portion 300 (e.g., between a first location and a second location in the turbine portion 300) may increase, resulting in an increase in the axial force on the movable sleeve 302 in the direction indicated by arrow 342. The movable sleeve 302 may translate axially, in the direction depicted by arrow 342, when the pressure differential exceeds a threshold pressure. FIG. 3B depicts the turbine portion 300 after movement of the movable sleeve 302 in the axial direction depicted by arrow 342. After the fluid pressure exceeds a threshold pressure, the movable sleeve 302 may move to the second position depicted in FIG. 3B to create or increase a gap between the stator blade 308 and the wall 316 of the movable sleeve 302. Similarly, the movable sleeve 302 may move to the second position depicted in FIG. 3B to increase a gap between the rotor blade 310 and the wall 316 of the movable sleeve 302. It should be appreciated that although FIGS. 3A and 3B illustrate two positions of the movable sleeve 302, the movable sleeve 302 may move to any number of positions between the first position and the second position illustrated in FIGS. 3A and 3B respectively. For example, as the pressure differential changes, the movable sleeve 302 may continuously move between the positions illustrated in FIGS. 3A and 3B and may stop movement at an intermediate position based on the pressure differential. The movable sleeve 302 may also assist in compensating for the occurrence of multiphase flows, e.g. such as in underbalance drilling operations, with appearance of gas slugs and hence abrupt density variations. The movable sleeve 302 may be responsive to a change of the density by variation of drag force on the movable sleeve 302, adjusting its axial position accordingly, and thus enabling continued power output of the turbine.

As shown in FIG. 3B, the movable sleeve 302 in the second position defines a stator gap 344 of width 346 between the wall 316 of the movable sleeve 302 and the tip 326 of the stator blade 308. In the second position shown in FIG. 3B, a rotor gap 350 has a width 352 greater than the width 330 defined when the movable sleeve 302 is in the first position. The spring 324 may be selected to determine the threshold pressure at which the spring compresses and the movable sleeve 302 translates, such that the gaps 344 and 350 are gradually opened while still providing sufficient force in all positions to restrict undesired movement of the movable sleeve 302 when the turbine portion 300 is subjected to axial shocks.

The axial movement of the movable sleeve 302 in the direction indicated by arrow 342 is restricted by the stationary sleeve 320, such that for a given wedge angle the movable sleeve 302 can translate a distance that opens sufficient clearance gaps for a maximum flow accommodated by the turbine portion 300. Seals 322 may be disposed between the stationary sleeve 320 and the movable sleeve 302 to prevent fluid leakage. In some embodiments, a small clearance flow passage between sleeves 302 and 320 may be used as a fluid shock absorber. Additionally or alternatively, in some embodiments, a gap 354 between the stationary sleeve 320 and the movable sleeve 302 may serve as a fluid shock absorber. The gap 354 may be selected to provide sufficient fluid viscous damping to counteract the effects from shock, vibrations, and fluid pressure pulsations. In some embodiments, fluid may be restricted in and out from the spring cavity 325 to absorb fluid energy.

As shown in FIG. 3B, the movable sleeve 302 may move to the first position in the direction indicated by arrow 356 when the fluid pressure differential decreases below a pressure differential threshold, such that the axial force exerted by the spring 324 in the direction indicated by arrow 356 moves the movable sleeve 302 in that direction. The axial movement of the movable sleeve 302 in the direction indicated by arrow 356 is restricted by the stator blade 308, such that the movable sleeve 302 may eliminate a gap between the stator tip 326 and the inner conical surface 334, as shown in FIG. 3A.

In some embodiments, the spring 324 may be a bi-stable spring that changes position in an abrupt transition from an initial position to a second position at a specific force value applied to the spring. In such embodiments, the spring 324 may return the movable sleeve 302 back to the initial position when the applied force is reduced below the specific force value. For example, in some embodiments a buckling plate or shell may be disposed between the stationary sleeve 320 and the movable sleeve 302. In some embodiments, the movable sleeve 302 may be moved via a different mechanism than the spring 324. For example, in some embodiments, a hydraulic actuator may be disposed between the stationary sleeve 320 and the movable sleeve 302, such that increases in the pressure differential result in movement of the hydraulic actuator and movement of the movable sleeve 302. In other embodiments, other suitable mechanisms for moving the movable sleeve 302 may be used.

In some embodiments, the stator gap 344, the rotor gap 350, or both may serve as anti-jamming gaps that enable debris in the fluid to wash out from the turbine portion 300. In such embodiments, the gaps 344 and 350 may be selected to provide sufficiently large clearances at a relatively high flow rate. In such embodiments, the relatively high flow rate may be used to open the gaps 344 and 350 to the allowable maximum width to flush out debris. In some embodiments, anti-jamming features may also include profiling the stator tip, the rotor tip, or both to form a cutting edge to cut debris into smaller pieces.

In the embodiments depicted in FIGS. 3A and 3B, a single rotor, a stator, and a movable sleeve may be selected to cover an entire operational flow range. Consequently, the same stator, rotor, and sleeves may be used across a variety of flow rate conditions, thus reducing M&S costs. Additionally, since no additional sleeves are installed or different turbines are used in different operating conditions, human errors related to installing appropriate sleeves or turbines may be eliminated. Additionally, in the embodiment depicted in FIGS. 3A and 3B, the maximum free spin velocity of the turbine portion 300 will only be achieved at the maximum flow of the operational flow range. For most of the operational flow range, the turbine will operate at lower speeds, thus increasing the life of power generation components such as face seals and increasing overall reliability. As noted above, the cross-sectional area of the turbine may increase if a large object (e.g., large debris) needs to pass through, thus enabling the turbine to operate using a smaller passage area and increase its cross-sectional area to prevent (or cure) jams. Moreover, the embodiments depicted in FIGS. 3A and 3B may include the flow bypass features described above with regard to the embodiment depicted in FIGS. 2A and 2B.

Additionally, in some embodiments, an alternator coupled to the turbine embodiments illustrated in FIGS. 3A and 3B may use a simplified alternator design, since the adjustment of the cross-sectional area may result in a self-regulating turbine speed that may level out alternator speed and voltage range. Moreover, it should be appreciated that although FIGS. 3A and 3B depict a single stage turbine embodiment, the movable sleeves may be used in other embodiments having multistage turbines.

Figure 4A:
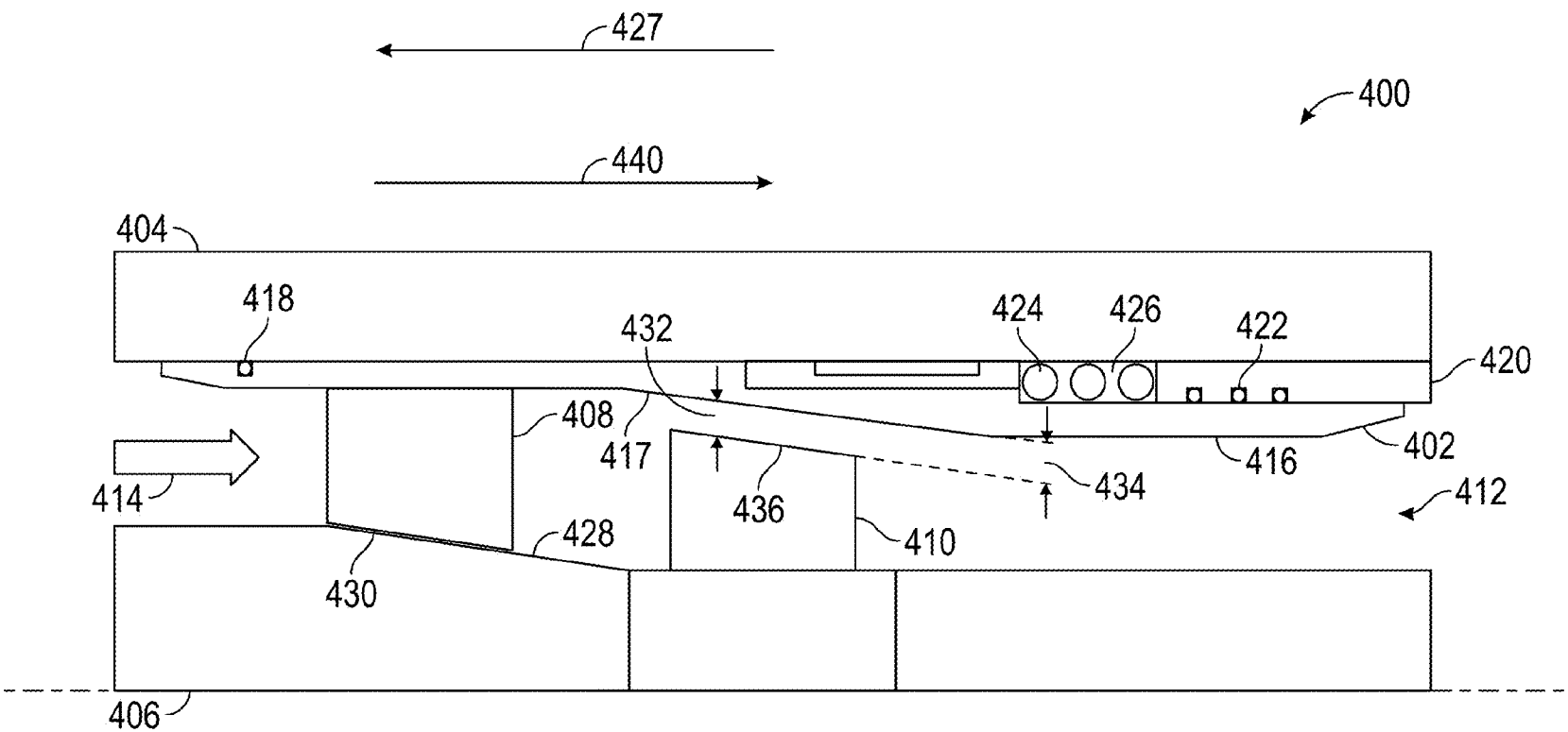
FIGS. 4A and 4B are schematic diagrams of a longitudinal cross-section of a turbine portion having a movable sleeve in accordance with an embodiment of the disclosure.
Figure 4B:
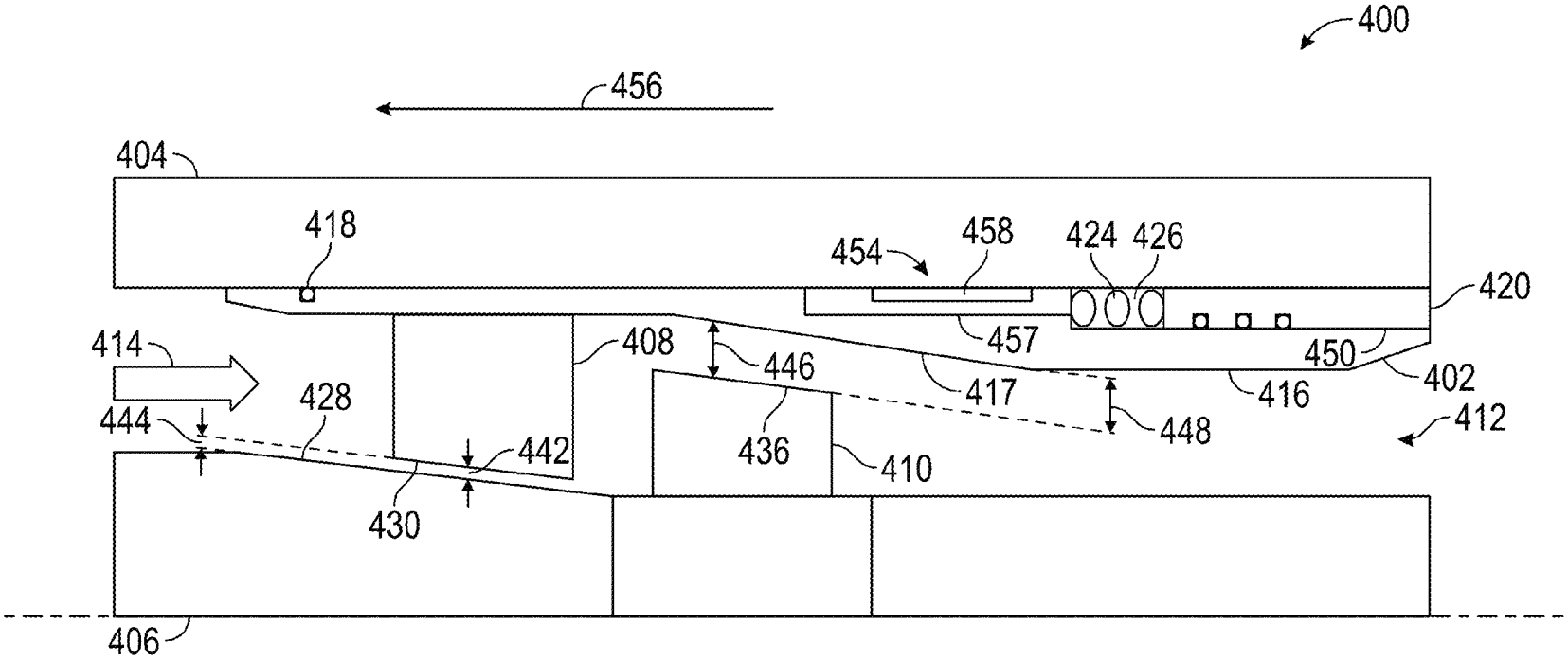

FIGS. 4A and 4B depict cross-sectional side views of an embodiment of a turbine portion 400 having a movable sleeve 402 in accordance with another embodiment of the disclosure. As depicted in FIG. 4A, the turbine portion 400 includes a housing 404, a hub 406, a stator blade 408 coupled to the movable sleeve 402, and a rotor blade 410. The housing 404 and the hub 406 may define an annulus 412 through which fluid may flow through the turbine portion 400. The rotor blade 410 may be coupled to the hub 406 and disposed within the annulus 412, with the rotor blade 410 coupled to a rotating portion of the hub 406. In contrast to the embodiment depicted in FIGS. 3A and 3B, the stator blade 408 is coupled to the movable sleeve 402 instead of the hub 406. In some embodiments, any number of stator blades 408 and rotor blades 410 may be included in the turbine portion 400. Fluid flow through the turbine portion 400 is represented by arrow 414.

The movable sleeve 402 may include an inner wall 416 having a conical surface 417 and a seal 418. The illustrated turbine portion 400 also includes a stationary sleeve 420 having debris excluders 422 that may prevent the spring from collecting solids that could restrict movement of the spring 424. A spring 424 may be disposed between the movable sleeve 402 and the stationary sleeve 420, such as in a spring cavity 426. As described further below, the movable sleeve 402 and the stator blade 408 may translate axially within the annulus 412 to define (e.g., increase, decrease, or eliminate) a gap between the stator blade 408 and a surface 428 of the hub 406 and a gap between the rotor blade 410 and the inner wall 416 of the movable sleeve 402.

As depicted in FIG. 4A, the movable sleeve 402 may be in a first position such that the spring 424 is in a preloaded state. At relatively low flow rates and as shown in FIG. 4A, the spring 424 may bias the movable sleeve 402 in the direction indicated by arrow 427 to push the stator blade 408 against the hub 406. Thus, in the first position illustrated in FIG. 4A, the gap between a tip 430 of the stator blade 408 and the surface 428 of the hub 406 is eliminated. In the first position, a rotor gap 432 having a width 434 may be defined between a tip 436 of the rotor blade 410 and the wall 416 of the movable sleeve 402, such that a minimal radial clearance exists between the movable sleeve 402 and the rotor blade tip 436 to avoid rubbing during operation of the turbine including shock conditions. In some embodiments, in the first position a relatively small gap may be maintained between the stator blade tip 430 and the surface 428 of the hub 406. As noted above, in such embodiments, a small gap in the first position may aid in minimize vibration or chattering at "lift-off" of the turbine.

In some embodiments, the inner conical surface of the movable sleeve 402 may have a similar or equal conical angle to the meridional profiles of the rotor tip 436, the stator tip 430, or both. Similarly, various portions of the hub 406 may have angled surfaces that may, in some embodiments, equal the conical angle of the inner conical surface, the stator tip 430, the rotor tip 436, or a combination thereof. In other embodiments, the movable sleeve 302 may have an inner surface having a different shape other than a conical surface.

As fluid flow increases in the direction indicated by arrow 440, the pressure differential across the turbine portion 400 (e.g., between a first location in the turbine portion 400 and a second location in the turbine portion 400) may increase, resulting in an increase in the axial force on the movable sleeve 402 and the stator blade 408 in the direction indicated by arrow 440. The movable sleeve 402 may translate axially to a second position, in the direction depicted by arrow 440, when the pressure differential exceeds a threshold pressure differential. FIG. 4B depicts the turbine portion 400 after movement of the movable sleeve 402 in the axial direction depicted by arrow 440. After the fluid pressure differential across the turbine portion 400 exceeds a threshold pressure differential, the movable sleeve 402 may move up to the second position depicted in FIG. 4B to create or increase a gap between the stator blade 408 and the surface 428 of the hub 406. Similarly, movement of the movable sleeve 402 up to the second position depicted in FIG. 4B may increase a gap between the rotor blade 410 and the wall 416 of the movable sleeve 402. It should be appreciated that although FIGS. 4A and 4B illustrate two positions of the movable sleeve 402, the movable sleeve 402 may move to any number of positions between the first position and second position illustrated in FIGS. 4A and 4B respectively. For example, as the pressure differential changes, the movable sleeve 402 may continuously move between the positions illustrated in FIGS. 4A and 4B and may stop movement at an intermediate position based on the pressure differential. In some embodiments, the movable sleeve 402 may also assist in compensating for the occurrence of multiphase flows, e.g. such as in underbalance drilling operations, with appearance of gas slugs and hence abrupt density variations. The movable sleeve 402 may be responsive to a change of the density by variation of drag force on the movable sleeve 402, adjusting its axial position accordingly, and thus enabling continued power output of the turbine.

As shown in FIG. 4B, the movable sleeve 402 in the second position defines a stator gap 442 of width 444 between the surface 428 of the hub 406 and the tip 430 of the stator blade 408. In the second position shown in FIG. 4B, a rotor gap 446 has a width 448 greater than the width 434 defined when the movable sleeve 402 is in the first position. The spring 424 may be selected to determine the threshold pressure at which the spring compresses and the movable sleeve 402 translates, such that gaps 442 and 446 are gradually opened while still providing sufficient force in all positions to restrict undesired movement of the movable sleeve 402 and the stator blade 408 when the turbine portion 400 is subjected to axial shocks. Since the stator blades may generate a relatively higher axial force than the movable sleeve 402 that is independent of the rotation speed of the rotor, the spring 424 may be stiffer than the spring 324 used in the embodiment depicted in FIGS. 3A and 3B.

The axial movement of the movable sleeve 402 and the stator blade 408 in the direction indicated by arrow 440 is restricted by the stationary sleeve 420, such that for a given wedge angle the movable sleeve 402 can translate a distance that opens sufficient clearance gaps for a maximum flow accommodated by the turbine portion 400. Similar to the embodiments described above, the seals 422 may be disposed between the stationary sleeve 420 and the movable sleeve 402 to prevent fluid leakage, and a small clearance flow passage between sleeves 402 and 420 may be used as a fluid shock absorber. Additionally or alternatively, in some embodiments, a gap 450 between the stationary sleeve 420 and the movable sleeve 402 may serve as a fluid shock absorber and may be selected to provide sufficient fluid viscous damping to counteract the effects from shock, vibrations, and fluid pressure pulsations. In some embodiments, fluid may be restricted in and out from the spring cavity 426 to absorb fluid energy.

As illustrated in FIG. 4B, the movable sleeve 402 and the stator blade 408 may move to the first position in the direction indicated by arrow 456 when the fluid pressure differential decreases below a pressure differential threshold. As the pressure differential decreases, the axial force exerted by the spring 424 in the direction indicated by arrow 456 moves the movable sleeve 402 and the stator blade 408 in that direction. The axial movement of the movable sleeve 402 in the direction indicated by arrow 456 is restricted by the engagement of the stator blade 408 with the hub 406, such that the axial movement reduces and then eliminates a gap between the stator tip 430 and the hub surface 428, as shown in FIG. 4A.

In some embodiments, the spring 424 may be a bi-stable spring that changes position in an abrupt transition from an initial position to a second position at a specific force value applied to the spring. In such embodiments, the spring 424 may return the movable sleeve 402 back to the initial position when the applied force is reduced below the specific force value. For example, in some embodiments a buckling plate or shell may be disposed between the stationary sleeve 420 and the movable sleeve 402. In some embodiments, the movable sleeve 402 may be moved via a different mechanism than the spring 424. For example, in some embodiments, a hydraulic actuator may be disposed between the stationary sleeve 420 and the movable sleeve 402, such that increases in the pressure differential result in movement of the hydraulic actuator and movement of the movable sleeve 402. In other embodiments, other suitable mechanisms for moving the movable sleeve 402 may be used.

The movable sleeve 402 may experience a relatively high torque in the circumferential direction generated by the stator blade 408 and the other stator blades coupled to the movable sleeve 402. In some embodiments, an anti-rotation device 454 may be installed between the movable sleeve 402 and one or more stationary components of the turbine portion 400, such as the stationary sleeve 420, the housing 404, or both. For example, as shown in FIG. 4B, the anti-rotation device 454 may include an anti-rotation slot 457 and a pin 458 that may engage the anti-rotation slot 457 to prevent rotation of the movable sleeve 402.

Figure 5:
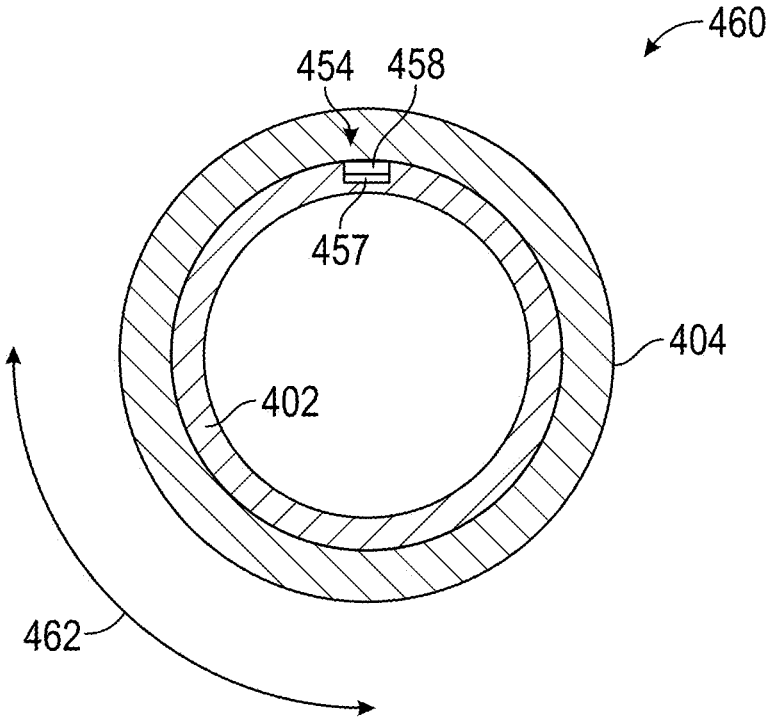
FIG. 5 is a schematic diagram of an axial cross-section of the turbine portion of FIGS. 4A and 4B in accordance with an embodiment of the disclosure.

FIG. 5 depicts a circumferential cross-section 460 of the turbine portion 400 in accordance with an embodiment of the disclosure. FIG. 5 shows the housing 404 and the movable sleeve 402 engaged via the anti-rotation device 454. As further shown in FIG. 5, the pin 458 may engage the anti-rotation slot 457 to prevent rotation of the movable sleeve 402 in the directions indicated by arrow 462 but still allow axial movement of the movable sleeve 402 as described above. In some embodiments, multiple pins and multiple slots may be installed between the housing 404 and the movable sleeve 402. In some embodiments, a pin and a slot may additionally or alternatively be installed between the movable sleeve 402 and the stationary sleeve 420.

Similar to the embodiment described in FIGS. 3A and 3B, the embodiment depicted in FIGS. 4A and 4B may use a single rotor, a stator, and a movable sleeve to cover an entire operational flow range, thus reducing M&S costs. As noted above, since no additional sleeves are installed or different turbines are used in different operating conditions, human errors related to installing appropriate sleeves or turbines may be eliminated. Additionally, in the embodiment depicted in FIGS. 4A and 4B, the maximum free spin velocity of the turbine portion 400 will only be achieved at the maximum flow of the operational flow range, and the turbine will operate at lower speeds in its operational flow range, thus increasing the life of power generation components and increasing overall reliability. Moreover, the embodiments depicted in FIGS. 4A and 4B may include the anti-jamming capability and flow bypass features described above.

Figure 6:
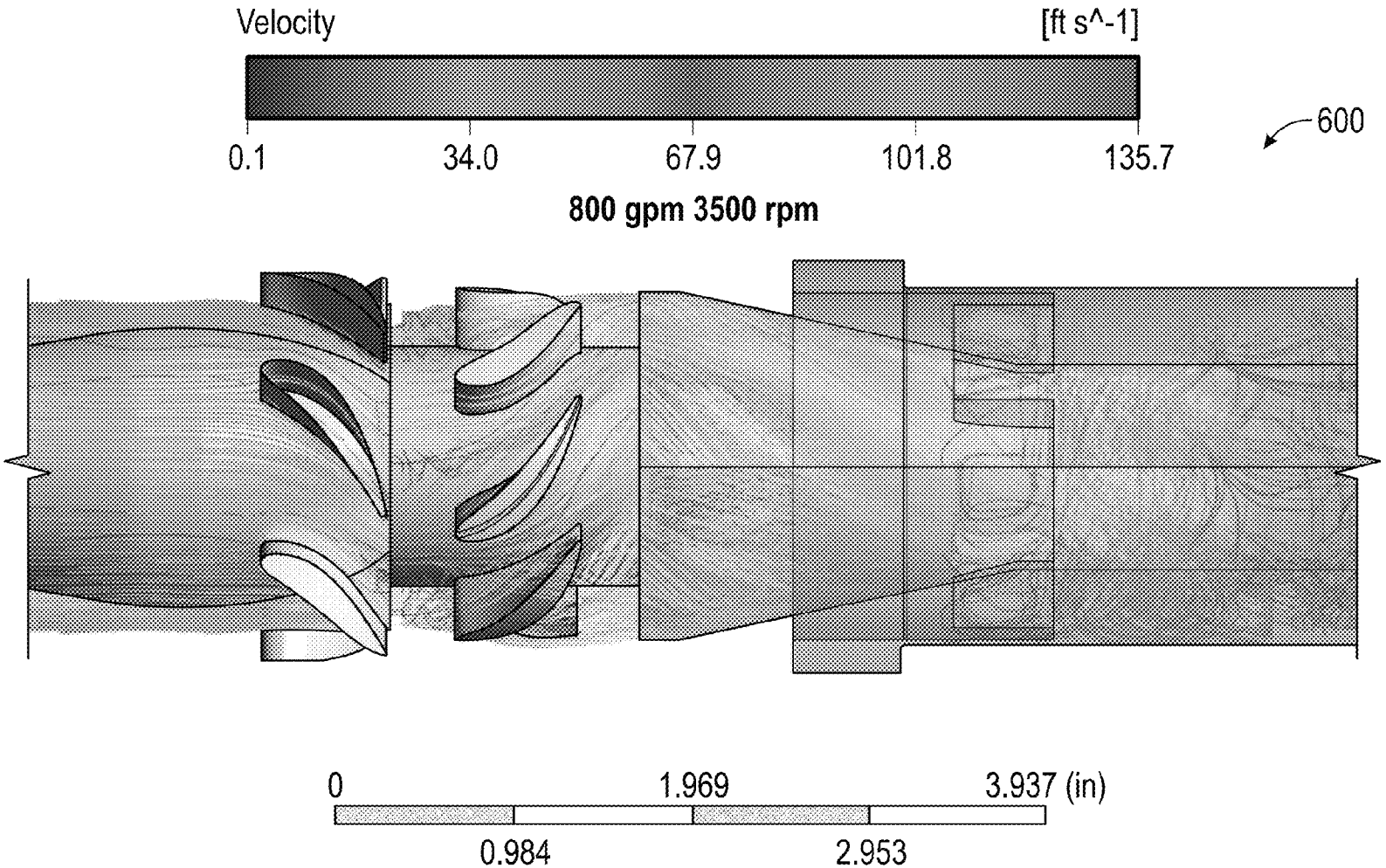
FIGS. 6 and 7 depict streamline plots of computational fluid dynamic (CFD) results illustrating fluid flow through a turbine in accordance with an embodiment of the disclosure.
Figure 7:
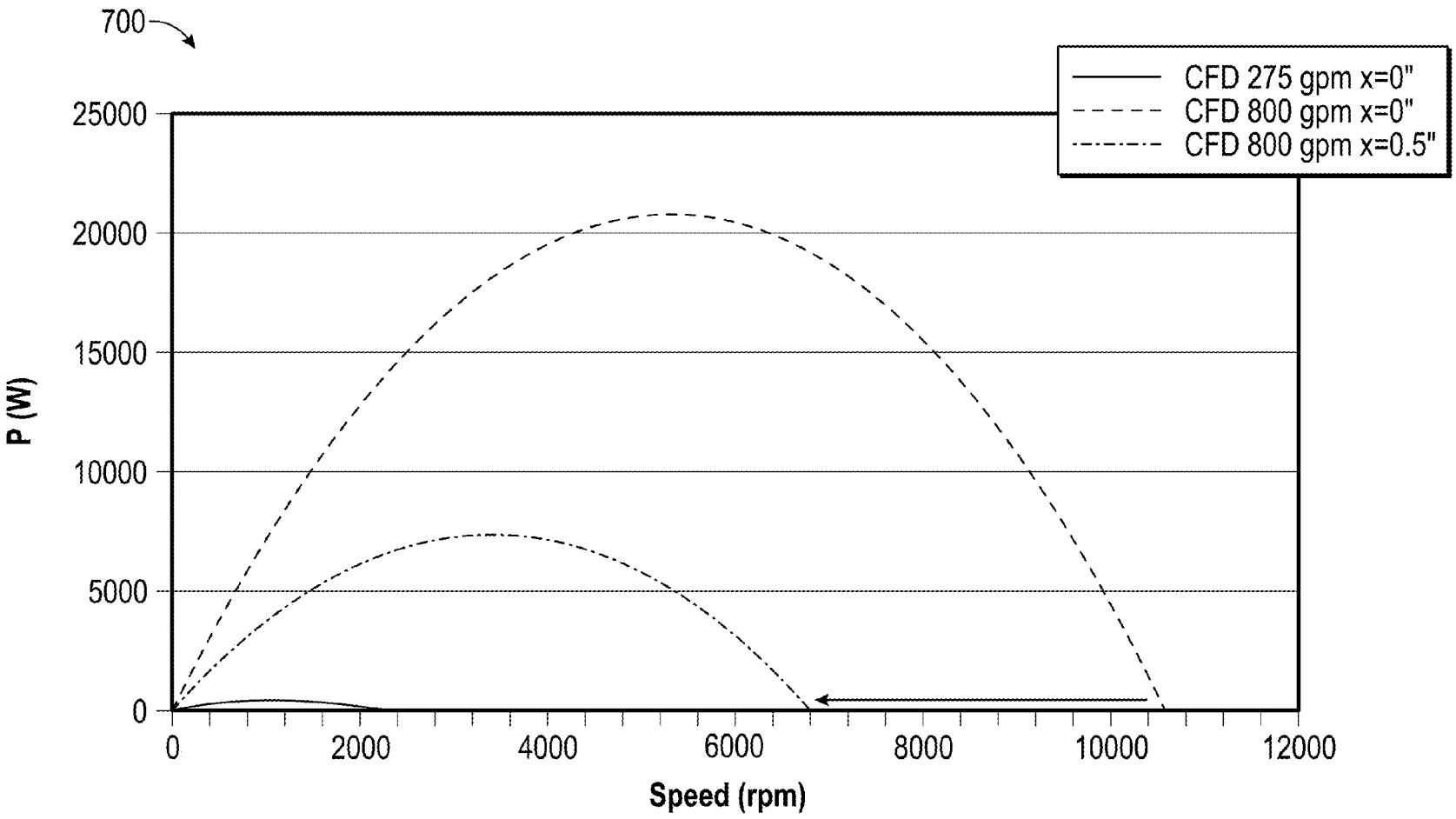

FIG. 6 depicts a streamline plot of computational fluid dynamic (CFD) results illustrating fluid flow through a turbine. FIG. 6 depicts a plot 600 showing a flow field for a turbine having no stator gap and a rotor gap between the rotor tip and a housing. FIG. 7 depicts a graph of shaft power (graph 700) as a function of the rotor speed based on the CFD results depicted in FIG. 6. As shown in FIG. 7, a turbine using the approximate 0 mm stator gap may accommodate a flow rate range of about 275 gpm to about 800 gpm until a free spin of approximately 10600 rpm. Moving a movable sleeve in the turbine about 0.5 inches lowers the turbine speed at the 800 gpm flow rate to about 6800 rpm.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense and not for purposes of limitation.

What is claimed is:

1. A turbine, comprising:

a movable sleeve disposed with the turbine and axially movable between a first position and a second position in response to changes in a pressure differential between a first location in the turbine and a second location in the turbine, the movable sleeve comprising an inner wall;

a stator blade coupled to the inner wall of the movable sleeve;

a rotor blade coupled to a hub of the turbine;

wherein the movable sleeve in the first position engages a tip of the stator blade with the hub of the turbine and defines a first gap having a first width between the tip of the rotor blade and the inner wall of the movable sleeve; and wherein the movable sleeve in the second position defines a second gap having a second width between the tip of the stator blade and the hub of the turbine, wherein the second width is greater than zero.

2. The turbine of claim 1, wherein the movable sleeve in the second position increases the first width of the first gap between the tip of the rotor blade and the inner wall of the movable sleeve.

3. The turbine of claim 1, comprising a stationary sleeve disposed adjacent to the movable sleeve, wherein the stationary sleeve limits the axial movement of the movable sleeve.

4. The turbine of claim 3, comprising a spring disposed between the movable sleeve and the stationary sleeve, wherein the spring is compressed when the movable sleeve is in the second position.

5. The turbine of claim 4, wherein the spring is configured to move the movable sleeve to the first position.

6. The turbine of claim 3, comprising a slot disposed between the movable sleeve and the stationary sleeve and configured to receive a pin, wherein engagement of the pin with the slot restricts rotation of the movable sleeve.

7. The turbine of claim 3, comprising a seal disposed between the movable sleeve and the stationary sleeve.

8. A turbine, comprising:

a movable sleeve disposed within the turbine and axially movable between a first position and a second position in response to changes in a pressure differential between a first location in the turbine and a second location in the turbine, the movable sleeve comprising an inner wall;

a stator blade coupled to a hub of the turbine, wherein a first width is defined between a tip of the stator blade and the inner wall of the movable sleeve;

a rotor blade coupled to the hub of the turbine, wherein a second width is defined between the tip of the rotor blade and the inner wall of the movable sleeve;

wherein the movable sleeve in the first position engages the tip of the stator blade such that the first width is about zero;

wherein the movable sleeve in the second position increases a gap between the tip of the stator blade and the surface of the hub such that the first width is greater than zero.

9. The turbine of claim 8, wherein the movable sleeve in the second position increases the second width between the tip of the rotor blade and the inner wall of the movable sleeve.

10. The turbine of claim 8, wherein when the movable sleeve is in the first position the second width is sufficient to prevent contact between the tip of the rotor blade and the inner wall during operation of the turbine.

11. The turbine of claim 8, comprising a stationary sleeve disposed adjacent to the movable sleeve, wherein the stationary sleeve limits the axial movement of the movable sleeve.

12. The turbine of claim 10, comprising a spring disposed between the movable sleeve and the stationary sleeve, wherein the spring is compressed when the movable sleeve is in the second position.

13. The turbine of claim 11, wherein the spring is configured to move the movable sleeve to the first position.

14. The turbine of claim 10, wherein the stationary sleeve and the movable sleeve define a fluid flow passage between the stationary sleeve and the movable sleeve.

15. The turbine of claim 8, wherein inner wall comprises an inner conical surface and the inner conical surface of the movable sleeve, the tip of the stator blade, and the tip of the rotor blade have substantially similar conical angles.

16. An apparatus, comprising:

a first removable sleeve disposed in a turbine and comprising a first inner wall, the first removable sleeve configured to define a first width between a tip of a stator blade and the first inner wall and configured to define a second width between a tip of a rotor blade and the inner surface of the first removable sleeve; and a second removable sleeve disposed within the turbine and comprising a second inner wall, the second removable sleeve configured to engage the tip of the stator blade such that the first width is about zero and configured to decrease the second width.

17. The apparatus of claim 16, wherein the first removable sleeve is configured to provide a first operational flow rate range for the turbine, and the second removable sleeve is configured to provide a second operational flow rate range for the turbine.

18. The apparatus of claim 16, comprising the turbine, wherein the turbine comprises:

a hub;

the stator blade, wherein the stator blade is coupled to the hub; and the rotor blade, wherein the rotor blade is coupled to the hub.

19. The apparatus of claim 16, wherein the first removable sleeve comprises a first seal configured to be disposed between the first removable sleeve and a housing of the turbine.

20. The apparatus of claim 16, wherein the second removable sleeve is configured to decrease the second width when disposed in the turbine such that the decreased second width is sufficient to prevent contact between the tip of the rotor blade and the second movable sleeve during operation of the turbine.

* * * * *